US010840635B2

(12) United States Patent
Zellner et al.

(10) Patent No.: US 10,840,635 B2
(45) Date of Patent: Nov. 17, 2020

(54) STRAIN AND PRESSURE RELIEF MECHANISM IN A PLUG CONNECTOR HOUSING

(71) Applicant: HARTING Electronics GmbH, Espelkamp (DE)

(72) Inventors: Joachim Zellner, Rinchnach (DE); Matthias Jungbeck, Teisnach (DE); Ernst Klees, Munich (DE)

(73) Assignee: HARTING Electronics GmbH, Espelkamp (DE)

( * ) Notice: Subject to any disclaimer, the term of this patent is extended or adjusted under 35 U.S.C. 154(b) by 0 days.

(21) Appl. No.: 16/610,894

(22) PCT Filed: May 14, 2018

(86) PCT No.: PCT/EP2018/062323
§ 371 (c)(1),
(2) Date: Nov. 4, 2019

(87) PCT Pub. No.: WO2018/210717
PCT Pub. Date: Nov. 22, 2018

(65) Prior Publication Data

US 2020/0076121 A1 Mar. 5, 2020

(30) Foreign Application Priority Data

May 15, 2017 (DE) ..... 10 2017 110 546

(51) Int. Cl.
*H01R 13/58* (2006.01)
*H01R 4/2433* (2018.01)
*H01R 13/585* (2006.01)

(52) U.S. Cl.
CPC ..... *H01R 13/5829* (2013.01); *H01R 4/2433* (2013.01); *H01R 13/585* (2013.01); *H01R 13/5825* (2013.01)

(58) Field of Classification Search
CPC ..... H01R 13/5829; H01R 13/582; H01R 13/5825; H01R 13/5804; H01R 13/5812; H01R 4/2433
See application file for complete search history.

(56) References Cited

U.S. PATENT DOCUMENTS

2008/0096417 A1 4/2008 Boeck et al.
2009/0318033 A1 12/2009 Tobey
(Continued)

FOREIGN PATENT DOCUMENTS

DE 102011052199 9/2012
DE 102016004429 A1 10/2017
(Continued)

*Primary Examiner* — Nguyen Tran
*Assistant Examiner* — Paul D Baillargeon
(74) *Attorney, Agent, or Firm* — Smartpat PLC

(57) ABSTRACT

A plug housing comprises at least one leaf spring element in a cable duct, which has a central part and a respective first and second lateral part which are bent in relation to said central part. The first lateral part is elastically bent via a first bending edge and the second lateral part is elastically bent via an opposing second bending edge on the central part. The central part extends substantially parallel to the cable duct. In relation to the central part, the first and the second lateral part adopt a respective variable acute angle and a variable respective height. The first and second lateral part narrow the cable duct such that, in an assembled state, a respective end section of the first and second lateral part press against the cable with a respective elastic force and thereby bring about the strain- and pressure-resistant securing of the cable.

10 Claims, 3 Drawing Sheets

(56) References Cited

U.S. PATENT DOCUMENTS

| | | | | |
|---|---|---|---|---|
| 2010/0015844 | A1 | 1/2010 | Martin et al. | |
| 2011/0300740 | A1 | 12/2011 | Schumann et al. | |
| 2012/0315790 | A1* | 12/2012 | Hein ..... | H01R 13/6593<br>439/574 |

FOREIGN PATENT DOCUMENTS

| | | | |
|---|---|---|---|
| EP | 0669681 | B1 | 12/2000 |
| EP | 1914844 | A2 | 4/2008 |
| EP | 2359441 | A1 | 6/2011 |
| JP | S54122098 | U | 8/1979 |
| WO | 2008071917 | A1 | 6/2008 |
| WO | 2014076269 | A1 | 5/2014 |

* cited by examiner

STRAIN AND PRESSURE RELIEF MECHANISM IN A PLUG CONNECTOR HOUSING

TECHNICAL FIELD

The present disclosure concerns a strain and pressure relief mechanism for a plug connector housing.

BACKGROUND

Usually, all plug connectors have a strain relief means for a cable which is electrically connected to the plug housing. The respective strain relief means may be formed very differently.

Conventionally, the strain relief means is formed for example by a yoke above a cable support element, between which the cable is clamped, wherein the cable support element is connected to the plug connector housing. The yoke is pushed or pulled against the cable support element by one or two screws.

WO2014/076269A1 discloses a strain relief means which is formed by conical studs or prongs in a cable channel, fixedly arranged in the interior of the cable channel and pointing into the cable channel. The cable channel comprises two housing parts or housing halves which can be folded onto each other transversely to the cable channel longitudinal axis so that the cable can be laid and enclosed therein. When the two housing parts are closed, the studs or prongs press into the cable or into a sheathing of the cable. The two housing parts may be pressed onto each other in stages via a latch mechanism or be pressed into each other in latching fashion. Tolerances in a cable diameter may be compensated by the latching stages. However, it is not always certain that the correct latching stage for achieving a reliable cable clamping has been set.

EP2359441B1 discloses a strain relief means which is formed by a contour in the cable channel of the plug connector housing, wherein the cable channel comprises two housing parts which can be folded onto each other transversely to the cable channel longitudinal axis so that the cable can be laid and enclosed therein. At least one of the housing parts is conductive in order to contact a screening line of the cable which is exposed in the region of the strain relief means. When the two housing parts, with the cable with the exposed screening line in between, are pressed together and closed, the contour of the housing parts presses into the screening line and at the same time clamps and contacts the cable. However, it is difficult to compensate for a tolerance in cable diameter.

DE102011052199B3 describes a strain relief means wound helically in a strip around the cable channel axis with inwardly protruding teeth, wherein the cable channel comprises two housing parts which can be folded onto each other transversely to the cable channel longitudinal axis so that the cable can be laid and enclosed therein. In a rear portion, the two housing parts on the outside each have a half thread, so that when folded together they form the thread onto which an end cap with a counter thread can be screwed. When the two housing parts are pressed together and closed, the studs or teeth press into the sheathing of the cable and lock this with the plug connector housing. The two housing parts are locked together by the end cap which is screwed onto the rear portions of the housing parts. The strain relief means may also contact the screening line of the cable. However, the tolerance of the cable diameter is only compensated within limits. It would also be advantageous if the cable were also securely held in its position against pressure forces.

WO2008071917A1 discloses a substantially two-part plug housing with a leaf spring element as the strain and pressure relief mechanism for the cable, wherein the strain and pressure relief mechanism is formed by serrated clamping elements which are integrated in two opposing cover parts and protrude therefrom towards the cable channel, and which are arranged substantially transversely to the cable channel longitudinal axis.

DE102016004429A1 discloses a multipart plug housing with a leaf spring element as a strain and pressure relief mechanism for the cable, wherein the strain and pressure relief mechanism is formed as a substantially annular spring element around the cable, pressed into the cable in the assembled state of the plug housing, and thereby held in the plug housing.

SUMMARY

The object of the disclosure is to eliminate the disadvantages from the prior art, and therefore comprises the provision of a plug connector with a strain and pressure relief mechanism for a cable, which allows as reliable a strain relief as possible for the cable even taking into account a tolerance of a cable diameter, wherein the strain relief is also achieved by as few separate parts as possible and as economically as possible.

The above object is achieved by a device and a method as claimed.

A plug housing with a first and a second housing part is provided, wherein the first and second housing part form between them a cable channel, and wherein the cable channel has a cable channel longitudinal axis which determines a cable guidance direction, and the cable channel contains at least one strain and pressure relief mechanism for fixing a cable securely against strain and pressure, wherein in the non-mounted state, the second housing part opens the cable channel for cable insertion and closes it in a mounted state. The at least one strain and pressure relief mechanism comprises at least one leaf spring element, wherein the leaf spring element has a middle part and a first side part and second side part bent away therefrom, wherein the first side part is elastically bent away from the middle part via a first bending edge and the second side part is elastically bent away from the middle part via a second bending edge which lies opposite the first bending edge on the middle part.

Here, the middle part extends along a middle part longitudinal axis between the first and the second bending edges, the first and the second bending edges are each formed perpendicularly to the middle part longitudinal axis, and the middle part longitudinal axis lies substantially in a common plane with the cable channel longitudinal axis.

The first side part may assume a variable acute first angle to the middle part, and the second side part may assume a variable acute second angle to the middle part, and a first end portion of the first side part lying opposite the first bending edge may assume a variable first height towards the middle part, and a second end portion of the second side part lying opposite the second bending edge may assume a variable second height towards the middle part.

The first and second side part constrict the cable channel so far that, in mounted state of the plug housing with the cable inserted, the respective first and second end portions press against the cable with the respective elastic force and thus fix the cable securely against strain and pressure.

Because the respective strain and pressure relief mechanism consists of an elastic leaf spring element, a tolerance in diameter of the cable may be easily compensated by spring travel which the leaf spring element inherently provides. Also, the leaf spring element may easily be secured in the cable channel and is cheap to produce. When several such leaf spring elements are arranged in the cable channel, a very reliable yet economic strain relief can be achieved.

For the sake of clarity, it is pointed out that when the term "a leaf spring element" or "the leaf spring element" is used, further leaf spring elements are not excluded and may also be part of the respective strain and pressure relief mechanism. Also for clarity, it is pointed out that when the term "a strain and pressure relief mechanism" or "the strain and pressure relief mechanism" is mentioned, further strain and pressure relief mechanism are not excluded which may also be part of the first and/or second housing parts or arranged in the cable channel.

A preferred embodiment provides two or more such leaf spring elements which are connected together via a connecting portion. The connecting portion may for example be connected to the cable channel or to the first or second housing part, so that also two or more leaf spring elements may be secured in the cable channel via a connection.

Also, a plurality of leaf spring elements may lie directly adjacent to each other and be configured integrally. In this case for example, one or more of the leaf spring elements may be connected to the first or second housing part. The effect of the strain relief for the cable increases with the number of respective strain and pressure relief mechanism and leaf spring elements. Thus simply via a number of strain and pressure relief mechanism in the cable channel, the intensity of strain relief may be determined and adapted to a requirement with optimal cost. If one type of preferred different types of strain and pressure relief mechanism is selected, the strain relief can easily be adapted to a predefined type of cable. In other words, preferably various strain and pressure relief mechanism or leaf spring elements are available for different cables and cable diameters, and may then be placed in the first and/or second housing part and connected thereto. Advantageously, the respective end portions of the first and second side part are formed so as to hold the cable in position so that it is also secure against twisting in the cable channel.

Preferably, the leaf spring element is made of metal and may also serve as a protective line or ground conductor. If the end portions run substantially perpendicularly to the cable channel longitudinal axis and to the cable longitudinal axis, and have prongs or needles with a predefined depth oriented in the direction of the cable, these may be configured such that they penetrate a sheath of the cable and come into connection with an internal protective line and contact this electrically. Damage to wires lying further inward can be prevented by the length of the prongs or needles.

Preferred embodiments of the present invention are depicted in the drawings which follow and in a detailed description, but do not restrict the present invention exclusively thereto.

BRIEF DESCRIPTION OF THE DRAWINGS

FIG. 4 an enlarged perspective view of the strain and pressure relief mechanism from FIG. 3 but without the housing part, comprising two leaf spring elements with connecting portion lying in between.

DETAILED DESCRIPTION

Figure 1:
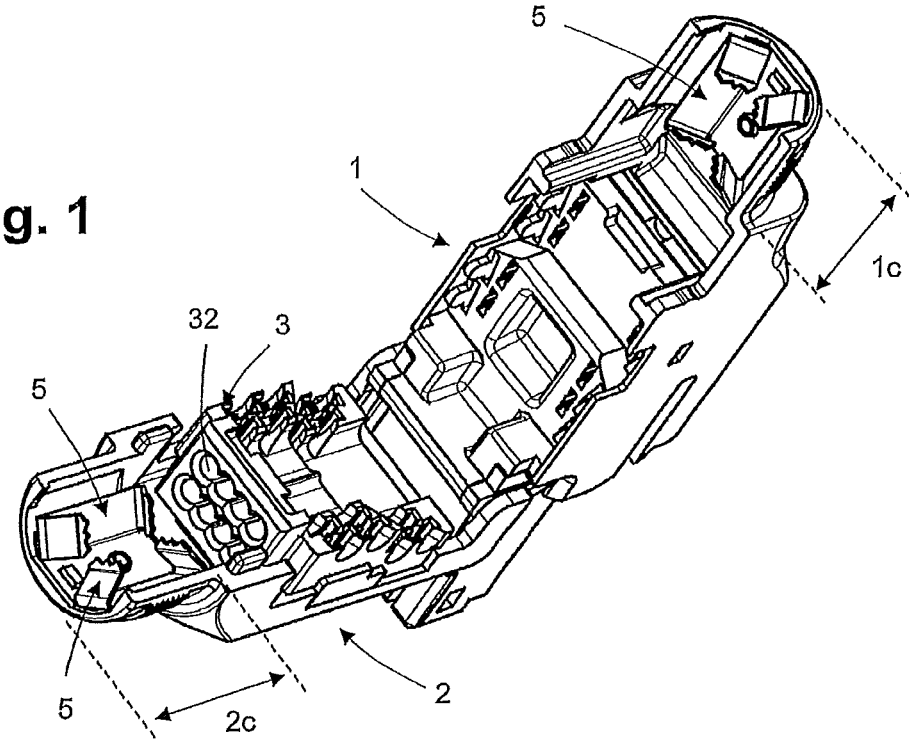
FIG. 1 is a perspective view of a plug housing with a first and a second housing part in open state, in each case with a rear portion with a strain and pressure relief mechanism.

FIG. 1 shows a preferred embodiment of a plug housing with a first 1 and a second housing part 2, wherein the first 1 and second housing part 2 in the connected state form between them a cable channel for a cable 6. The cable channel has a cable channel longitudinal axis 16 which determines a cable guidance direction and is sketched in FIG. 2. The cable channel contains at least one strain and pressure relief mechanism for fixing a cable 6 securely against strain and pressure. The first 1 and second housing part 2 are configured such that in the non-mounted. i.e. open state, the second housing part 2 opens the cable channel for cable insertion and closes it in a mounted state. The mounted state results when the first housing part 1 is connected to the second housing part 2 and the cable channel is thus formed. The at least one strain and pressure relief mechanism comprises at least one leaf spring element 5 which has a respective middle part 50 with a first side part 52 and second side part 52*b* each bent away therefrom. The respective first side part 52 is elastically bent away from the respective middle part 50 via a respective first bending edge 51, and the respective second side part 52*b* is elastically bent away from the respective middle part 50 via a respective second bending edge 51*b* which lies opposite the respective first bending edge 51 on the respective middle part 50.

For clarity, it is pointed out that in the description which follows, for the components of the leaf spring element 5, the word "respective" is usually omitted for easier reading, and it is pointed out that the first middle part 50, the first side part 52, the second side part 52*b*, the first bending edge 51, the second bending edge 52 and further components always refer to the respective leaf spring element. The first middle part 50, the first side part 52, the second side part 52*b*, the first bending edge 51, the second bending edge 52 and further components of a first leaf spring element 5 may be different from or the same as the respective components of a second or further leaf spring element 5.

The middle part 50 extends along a middle part longitudinal axis between the first 51 and the second bending edge 51*b*, wherein the first 51 and the second bending edge 51*b* are each formed perpendicularly to the middle part longitudinal axis. The strain and pressure relief mechanism or the leaf spring element 5 is arranged in the cable channel such that the middle part longitudinal axis lies substantially in a common plane with the cable channel longitudinal axis 16. Preferably, the middle part longitudinal axis is substantially parallel to the cable channel longitudinal axis 16, but it may also form an angle thereto.

The leaf spring element is bent such that the first side part 52 may assume a variable acute first angle to the middle part 50, and the second side part 52*b* may assume a variable acute second angle to the middle part 50. The respective first and second acute angles, together with the cable or more precisely with the cable sheathing or an inner screening line, create a barbed effect which connects the cable to the plug housing in a manner which is particularly secure against strain and pressure. A first end portion 53 of the first side part 52 lying opposite the first bending edge 51 may assume a variable first height towards the middle part 50, and a second end portion 53*b* of the second side part 52*b* lying opposite the second bending edge 51*b* may assume a variable second height towards the middle part 50. Due to the elasticity of the spring element, the first and second acute angles and the first and second heights are set when the first 52 or second side part 52*b* are pressed together in mounted state by an inlaid cable 6 in the cable channel, and a corresponding elastic force is then produced according to the spring law.

The first 52 and second side part 52*b* constrict the cable channel so far that, in mounted state of the plug housing with the cable 6 inserted, the respective first 53 and second end portion 53*b* press against the cable with the respective elastic force and thus fix the cable 6 securely against strain and pressure.

The strain and pressure-resistant fixing is partially achieved by a friction force between the respective side parts 52, 52*b* and the cable 6. The first 52 or second side part 52*b* or a respective end portion thereof is partially pressed into the cable 6, so that a geometric deformation of a surface of the cable 6 increases the strain and pressure-resistance of the cable in the plug housing. For the sake of clarity, it is pointed out that the term "cable 6" or "surface of the cable 6" in connection with strain relief always means a cable clamping portion of the cable 6 which is in direct contact with the respective strain and pressure relief mechanism. The cable clamping portion of the cable may for example be a cable sheath or protective line which preferably surrounds the inner cores of the cable in the manner of a sheath.

FIG. 1 shows the preferred plug housing with the first 1 and second housing part 2 in open state, wherein a preferred strain and pressure relief mechanism, comprising two leaf spring elements 5 in each case, is arranged in both a first rear portion 1*c* of the first housing part 1 and in a second rear portion 2*c* of the second housing part 2. The second housing part 2 also comprises a connection block 3 with wire channels 32, in which the respective wires of the cable 6 are introduced and electrically connected.

Figure 2:
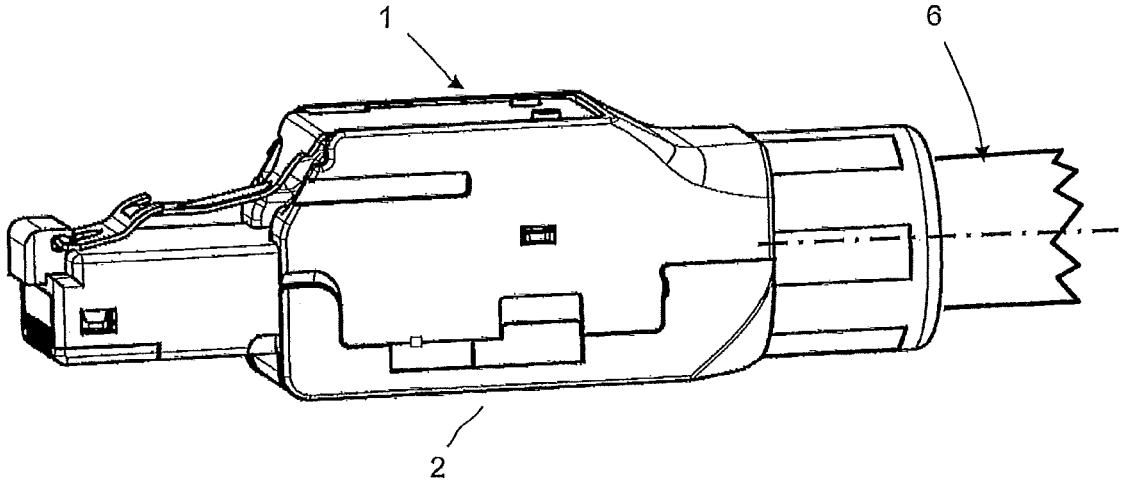
FIG. 2 is a perspective view of the plug housing from FIG. 1 with the first and second housing part in a closed state, also with an end cap on the rear portion.

FIG. 2 shows the preferred plug housing from FIG. 1 in a closed state and also sealed by an end cap. In a front part, the preferred plug housing—which represents an RJ45 plug—has plug contacts 42.

Figure 4:
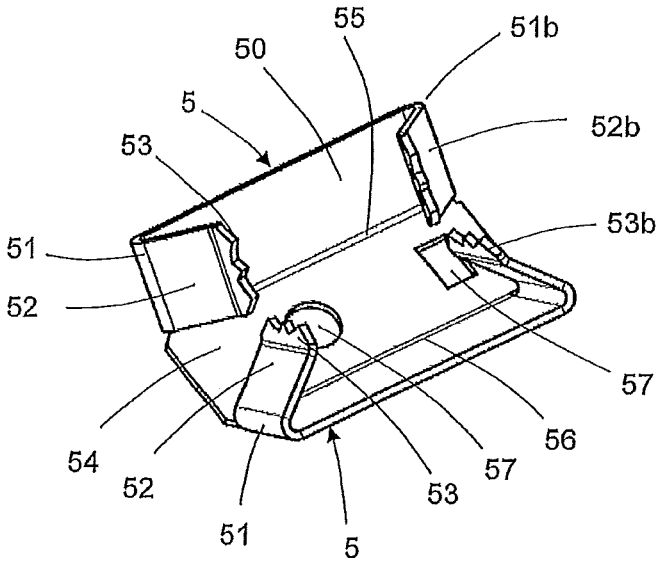
Figure 5:
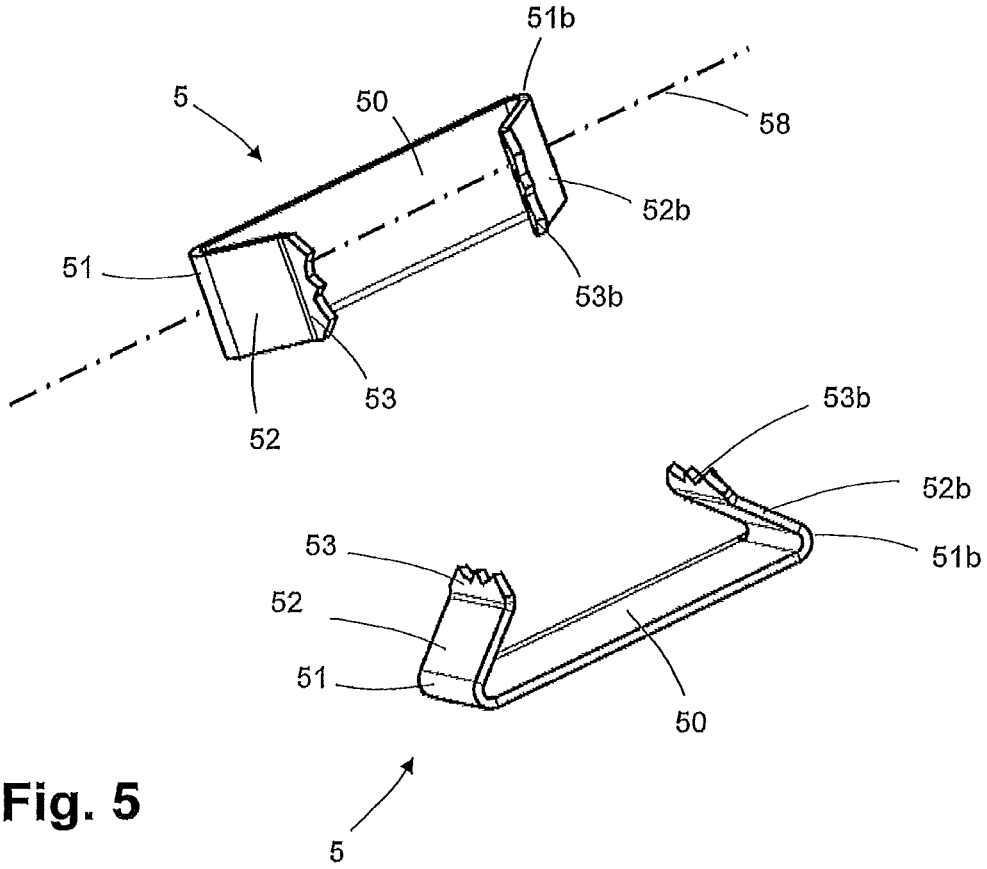
FIG. 5 is an enlarged perspective view of another preferred strain and pressure relief mechanism which consists solely of the leaf spring element.
Figure 6:
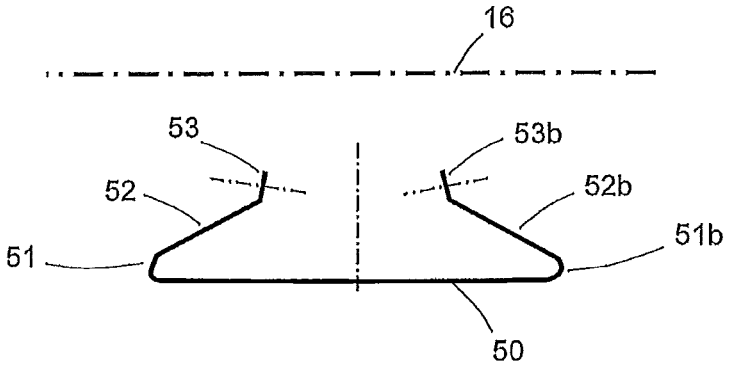
FIG. 6 is an enlarged side view of the other preferred strain and pressure relief mechanism from FIG. 5.

FIG. 4 shows a preferred embodiment of the leaf spring element 5 in which the middle part longitudinal axis 58 is drawn in dotted lines. FIG. 6 shows the preferred leaf spring element 5 from FIG. 5 in a side view, with respective mid-perpendiculars to the middle part 50 and to the first 53 and to the second end portion 53*b* drawn in dotted lines. The mid-perpendicular of the middle part 50 runs perpendicularly to the cable channel longitudinal axis 16.

Preferably, the first end portion 53 is bent away from the first side part 52 via a further bending edge and forms a first end portion face with a first mid-perpendicular which has an angle of 0 to 30° to the cable channel longitudinal axis 16 in the relaxed state. Preferably, the first mid-perpendicular, with the cable inserted and in mounted state, forms an angle of 0 to 30° to the cable channel longitudinal axis 16. Preferably, the first end portion 53 is also not bent away from the first side part 52.

Preferably, the second end portion 53*b* is bent away from the second side part 52*b* via a second further bending edge and forms a second end portion face with a second mid-perpendicular which has an angle of 0 to 30° to the cable channel longitudinal axis 16 in the relaxed state. Preferably, the second mid-perpendicular, with the cable inserted and in mounted state, forms an angle of 0 to 30° to the cable channel longitudinal axis 16. Preferably, the second end portion 53*b* is also not bent away from the second side part 52*b*.

The first 53 and/or the second end portion 53*b* may have an edge oriented towards the cable 6 which is straight, curved, rounded and/or serrated. Preferably, the first 53 and/or the second end portion 53*b* has a form which holds the cable 6 so as also to be secure against twisting, for example by prongs or by a sawtooth form.

Preferably, the further bending edge of the first 53 and/or second end portion 53*b* is substantially parallel to the respective first 51 or second bending edge 52*b*.

Preferably, the middle part 50 is connected to the first 1 and/or second housing part 2 inside the cable channel by at least one of the following connections: a hole-peg joint, a mastic joint, a weld joint, a solder joint, a bolted joint, a riveted joint, a clamping joint, a clamping joint in a recess, a vulcanization joint, a groove-peg joint, a latching or snap-lock joint, or a combination thereof.

Preferably, the middle part 50 is integrally connected to the first 1 and/or second housing part 2.

Preferably, the mid-perpendicular of the middle part 50 forms an angle in a range from 70° to 90° to the cable channel longitudinal axis 16.

Preferably, the middle part longitudinal axis 58 is formed parallel to the cable channel longitudinal axis 16 or has an angle to this in the range from 0° to 20°.

Preferably, the middle part 50 extends flat and substantially in a middle part plane between the first 51 and the second bending edge 51*b*.

Preferably, the first bending edge 51 points in the direction of a first cable end, from which at least one wire protrudes in order to be connected to the corresponding plug contact 42 in the plug housing, and the second bending edge 51*b* points in the direction of a second cable end which protrudes from the plug housing. The second end of the cable thus extends away from the plug housing.

Preferably, the first 51 and the second bending edge 51*b* each run along a straight line or alternatively are preferably slightly curved in order to increase a spring force. Preferably, the first 51 and the second bending edge 51*b* are each an elastic bending edge.

Preferably, the variable acute first angle in the relaxed state lies in a range from 30° to 45°. Further preferably, the first angle lies in a range from 45° to 60° or in a range from 60° to 70°.

Preferably, the variable acute second angle in the relaxed state lies in a range from 30° to 45°. Further preferably, the second angle lies in a range from 45° to 60° or in a range from 60° to 70°.

Preferably, the variable first height is formed substantially by the variable first angle, and the variable second height is formed substantially by the variable second angle.

Preferably, the leaf spring element 5 has substantially a constant width along the middle part 50 and along the first 52 and the second side part 52*b*. Alternatively, it is also conceivable that the first 53 and the second end portion 53*b* have a smaller width than the associated middle part 50, wherein the first 52 and the second side part 52*b* for example have a trapezoid form.

Preferably, the at least one strain and pressure relief mechanism comprise a first leaf spring element 5 and at least a second leaf spring element 5 which are integrally connected together. Here, the first middle part 50 of the first leaf spring element 5 has at the side, parallel to the middle part longitudinal axis 58, a third bending edge 55 which also forms a connection to a second middle part 50 of the second leaf spring element 5, wherein a respective middle part longitudinal axis 58 of the first and of the second leaf spring element 5 run parallel to each other. The first 5 and second leaf spring element 5 are bent relative to each other via the third bending edge 55 such that the mid-perpendicular of the first middle part 50 of the first leaf spring element 5 and the mid-perpendicular of the second middle part 50 of the second leaf spring element 5 are each oriented substantially towards the cable channel longitudinal axis 16.

Preferably, the at least one strain and pressure relief mechanism comprise a plurality of leaf spring elements 5 which are arranged next to each other, with respective middle part 50 against middle part 50, and bent away from each other such that the respective middle parts 50 each have at least one bending edge parallel to the third bending edge 55, the middle part longitudinal axes 58 of which run parallel to each other. Here, all respective middle part longitudinal axes 58 of the respective leaf spring elements 5 run parallel to each other, and all respective mid-perpendiculars of the respective middle parts 50 are oriented towards the cable channel longitudinal axis 16.

Preferably, the first 52 and the second side part 52*b* of the respective leaf spring element 5 are formed tapering in a trapezoid form towards the cable channel longitudinal axis 16.

Figure 3:
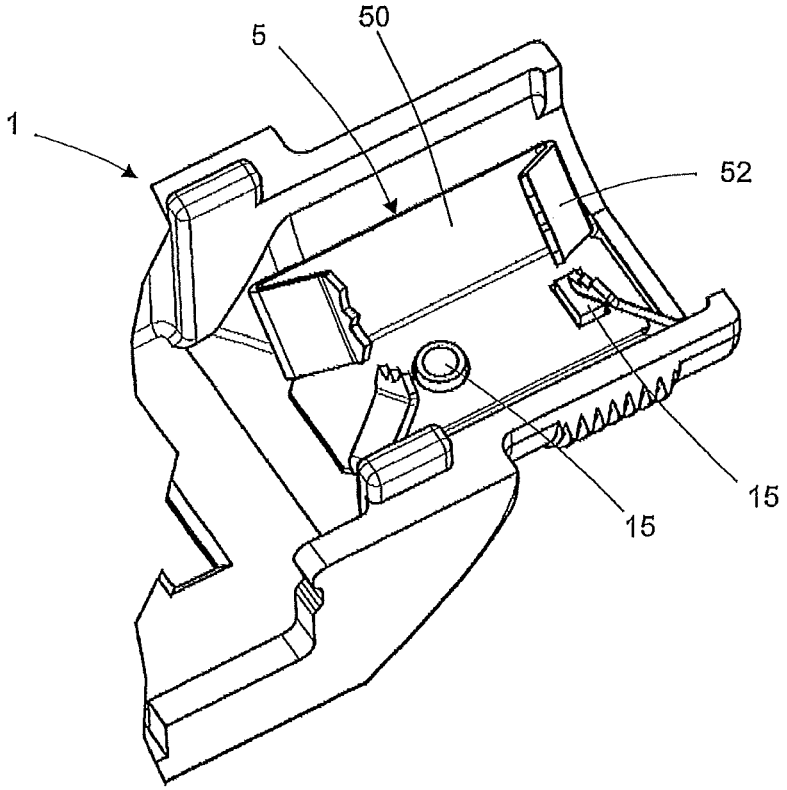
FIG. 3 is an enlarged perspective view of the rear portion of the first housing part from FIG. 1, as an extract therefrom and in open state, with the strain and pressure relief mechanism.

FIG. 3 and FIG. 4 show a further preferred embodiment in which the first leaf spring element 5 is integrally connected to the second leaf spring element 5 via an intermediate connecting portion 54. The connecting portion 54 is arranged between the first middle part 50 of the first leaf spring element 5 and the second middle part 50 of the second leaf spring element 5 such that the first middle part 50 transforms directly into the connecting portion 54 via the third bending edge. The connecting portion 54 here has a connecting portion longitudinal axis which is parallel to the first middle part longitudinal axis 58 of the first middle part 50. On the side opposite the third bending edge 55, the connecting portion 54 has a fourth bending edge 56 parallel thereto, which also forms a connection to the second middle part 50 of the second leaf spring element 5. The middle part longitudinal axis 58 of the first leaf spring element 5, the connecting portion longitudinal axis of the connecting portion 54, and the middle part longitudinal axis 58 of the second leaf spring element 5, each run substantially parallel to each other.

Preferably, the first leaf spring element 5 and the second leaf spring element 5 are bent relative to each other via the respective third 55 and fourth bending edge 56 and via the intermediate connecting portion 54 such that the respective mid-perpendiculars of the first middle part 50, the second middle part 50 and where applicable further adjacent middle parts 50, are oriented substantially towards the cable channel longitudinal axis. The phrase "oriented towards the cable channel longitudinal axis" preferably means that the respective mid-perpendicular intersects a cylindrical region around the cable channel longitudinal axis which has a diameter which corresponds to half the cable diameter.

Preferably, the connecting portion 54 has at least one first mechanical contact element 57 for creating a mechanical connection to the cable channel or to the first 1 or second housing part 2. The first mechanical contact element 57 may here for example be a mastic surface, a hole, a peg, a weld point, an edge, a rivet, or a rivet hole, a screw or a nut, a protrusion or similar.

Preferably, the connecting portion 54 is connected to the first 1 or second housing part 2 by at least one of the following connections: a hole-peg joint, a mastic joint, a weld joint, a solder joint, a bolted joint, a riveted joint, a clamping joint, a clamping joint in a recess, a vulcanization joint, a groove-peg joint, a latching or snap-lock joint, or a combination thereof.

Preferably, the first 1 or second housing part 2 has a second mechanical contact element 15 corresponding to the first mechanical contact element 57, which is or can be connected to the first mechanical contact element 57. The strain and pressure relief mechanism is thus held correspondingly in position.

Preferably, the connecting portion 54 is integrally connected to the first 1 or second housing part 2. Preferably, the connecting portion 54 is connected to the first 1 or second housing part 2 by at least two connections, which further preferably together are secure against twisting.

Preferably, the third 55 and fourth bending edge 56 are each an elastic bending edge. Preferably, the third 55 and the fourth bending edge 56 run in a straight line or in a curve.

Preferably, at least one middle part 50 comprises the at least one first mechanical contact element 57 for connection to the cable channel or to the first 1 or second housing part 2 in order to be held in position.

Here, the at least one middle part 50 is connected to the first 1 or second housing part 2 by at least one of the following connections: a hole-peg joint, a mastic joint, a weld joint, a solder joint, a bolted joint, a riveted joint, a clamping joint, a clamping joint in a recess, a vulcanization joint, a groove-peg joint, a latching or snap-lock joint, or a combination thereof.

Preferably, the leaf spring element 5 consists partly of one of the following materials or a mixture thereof: metal, spring steel, copper beryllium, plastic, an insulating coating, carbon fiber composite or a composite material.

Preferably, the first end portion 53 has a serrated edge at an outer end pointing towards the cable channel longitudinal axis. Preferably, the second end portion 53*b* has a serrated edge at an outer end pointing towards the cable channel longitudinal axis.

Preferably, the plug housing in the cable channel has a plurality of strain and pressure relief mechanism which are each oriented towards the cable channel longitudinal axis and preferably attached therein to be secure against falling out.

Preferably, the first 1 and/or the second housing part 2 is an injection molding. Preferably, the leaf spring element 5 is an injection molding, a punched part, a bent part, a rolled part, a drawn part or a compressed part.

Preferably, the leaf spring element 5 has a flat and substantially rectangular cross-section. Preferably, the cross-section may vary from the middle part to the first 53 and the second end portion 53.

For clarity, it is pointed out that the term "plug contact" means an electromechanical plug contact for electrical connection to a matching other plug contact of another plug connector corresponding to the plug connector. For the sake of clarity, the wire comprises at least one core and an external insulation. For clarity, it is pointed out that the term "plug housing" is equivalent to the term "plug connector housing". A screening line preferably means a casing-like screening line which surrounds the further inner cores of the cable 6.

For the sake of clarity, it is pointed out that the terms "upper", "lower", "top side", "underside" and other relative spatial indications lie in the vertical direction and as shown in the figures, unless described in a different orientation.

For clarity, it is pointed out that the feature in which the respective mid-perpendicular of the respective middle part 50 is oriented towards the cable channel longitudinal axis, means that this is the respective mid-perpendicular which results in the state with the cable mounted, wherein the respective mid-perpendicular here intersects a virtual cable diameter which amounts to 50% of the actual predefined cable diameter.

Further possible embodiments are described in the following claims. In particular, the various features of the above-mentioned embodiments may be combined with each other unless technically excluded.

The reference signs given in the claims serve for greater clarity and in no way restrict the claims to the forms shown in figures.

LIST OF REFERENCE SIGNS

1 First housing part
1*c* Rear portion of first housing part
15 Second mechanical contact element
16 Cable channel longitudinal axis
2 Second housing part (preferably pivotable housing cover)
2*c* Rear portion of second housing part
3 Connection block
32 Wire channel
42 Plug contact
5 Leaf spring element
50 Middle part
51 First bending edge
51*b* Second bending edge
52 First side part
52*b* Second side part
53 First end portion
53*b* Second end portion
54 Connecting portion
55 Third bending edge
56 Fourth bending edge
57 First mechanical contact element
58 Middle part longitudinal axis
6 Cable

The invention claimed is:

1. A plug housing with a first (1) and a second housing part (2), wherein the first (1) and second housing part (2) form between them a cable channel, wherein the cable channel has a cable channel longitudinal axis (16) which determines a cable guidance direction, and the cable channel contains at least one strain and pressure relief mechanism for fixing a cable securely against strain and pressure, wherein in a non-mounted state, the second housing part (2) opens the cable channel for cable insertion and closes it in a mounted state, wherein the at least one strain and pressure relief mechanism comprises at least one leaf spring element (5) which has a middle part (50) and a first side part (52) and second side part (52*b*) bent away therefrom, wherein the first side part (52) is elastically bent away from the middle part (50) via a first bending edge (51), and the second side part (52*b*) is elastically bent away from the middle part (50) via a second bending edge (51*b*) which lies opposite the first bending edge (51) on the middle part (50);

wherein the middle part (50) extends along a middle part longitudinal axis between the first (51) and the second bending edge (51*b*), wherein the first (51) and the second bending edge (51*b*) are each formed perpendicularly to the middle part longitudinal axis, and wherein the middle part longitudinal axis lies substantially in a parallel plane with the cable channel longitudinal axis;

wherein the first side part (52) is arranged at a variable acute first angle to the middle part (50), and wherein the second side part (52*b*) is arranged at a variable acute second angle to the middle part (50), and wherein a first end portion (53) of the first side part (52) lying opposite the first bending edge (51) is arranged at a variable first height towards the middle part (50), and wherein a second end portion (53*b*) of the second side part (52*b*) lying opposite the second bending edge (51*b*) is arranged at a variable second height towards the middle part (50); and wherein the first (52) and second side part (52*b*) constrict the cable channel so far that, in the mounted state of the plug housing with a cable inserted, the respective first (53) and second end portion (53*b*) press against the cable with a respective elastic force and thus fix the cable securely against strain and pressure.

2. The plug housing as claimed in claim 1, wherein the first end portion (53) is bent away from the first side part (52) via a further bending edge and forms a first end portion face (53) with a first mid-perpendicular which has an angle of 0 to 30° to the cable channel longitudinal axis in a relaxed state; and wherein the second end portion (53*b*) is bent away from the second side part (52*b*) via a second further bending edge and forms a second end portion face with a second mid-perpendicular which has an angle of 0 to 30° to the cable channel longitudinal axis in the relaxed state.

3. The plug housing as claimed in claim 2, wherein the further bending edge of the first (53) and the second further bending edge of the second end portion (53*b*) are parallel to the respective first (51) or second bending edge (52*b*).

4. The plug housing as claimed in claim 1, wherein the variable acute first angle in a relaxed state lies in a range from 30° to 45°; and wherein the variable acute second angle in the relaxed state lies in a range from 30° to 45°.

5. The plug housing according to claim 1, wherein the at least one strain and pressure relief mechanism comprises a first leaf spring element (5) and at least a second leaf spring element (5) which are integrally connected together, wherein a first middle part (50) of the first leaf spring element (5) has at the side, parallel to the middle part longitudinal axis, a third bending edge (55) which also forms a connection to a second middle part (50) of the second leaf spring element (5), wherein all middle part longitudinal axes of the respective middle parts (50) run parallel to each other, wherein the first and second leaf spring element (5) are bent relative to each other via the third bending edge (55) such that all mid-perpendiculars of the respective middle parts (50) are oriented towards the cable channel longitudinal axis.

6. The plug housing as claimed in claim 5, wherein the at least one strain and pressure relief mechanism comprises a plurality of leaf spring elements (5) which are arranged next to each other, with respective middle part (50) against middle part (50), and bent away from each other such that the respective middle part (50) each has at least one bending edge parallel to the third bending edge (55), and the middle part longitudinal axes of which run parallel to each other; and/or wherein the third bending edge forms an elastic connection.

7. The plug housing as claimed in claim 5, wherein a connecting portion (54) is arranged between the first middle part (50) and the second middle part (50) such that the third bending edge (55) is adjoined by the connecting portion (54) which has a connecting part longitudinal axis which is parallel to the respective middle part longitudinal axis of the first and second middle part (50), wherein on the side opposite the third bending edge (55), the connecting portion (54) has a fourth bending edge (56) parallel thereto which also forms a connection to the second middle part (50) of the second leaf spring element (5).

8. The plug housing as claimed in claim 7, wherein the connecting portion (54) has at least one first mechanical contact element (57) for connection to the cable channel or to the first (1) or second housing part (2) in order to be held in position.

9. The plug housing according to claim 1, wherein the middle part (50) comprises a first mechanical contact element (57) for connection to the cable channel or to the first (1) or second housing part (2) in order to be held in position.

10. The plug housing as claimed in claim 1, wherein the first end portion (53) has a serrated edge at an outer end pointing towards the cable channel longitudinal axis; and wherein the second end portion (53*b*) has a serrated edge at an outer end pointing towards the cable channel longitudinal axis.

* * * * *